US010555845B2

(12) United States Patent
Gingras et al.

(10) Patent No.: US 10,555,845 B2
(45) Date of Patent: Feb. 11, 2020

(54) WHEELCHAIR REAR WHEEL SUPPORT ASSEMBLY AND DETACHABLE ARMREST

(71) Applicant: MOTION COMPOSITES INC, Saint-Roch-de-l'Achigan (CA)

(72) Inventors: David Gingras, L'Assomption (CA); Michael Archambault, Saint-Roch-de-l'Achigan (CA); Pierre-Andre Couture, Laval (CA); Jacques Desbiens, Montreal (CA)

(73) Assignee: MOTION COMPOSITES INC, Saint-Roch-de-l'Achigan (CA)

( * ) Notice: Subject to any disclaimer, the term of this patent is extended or adjusted under 35 U.S.C. 154(b) by 150 days.

(21) Appl. No.: 15/811,073

(22) Filed: Nov. 13, 2017

(65) Prior Publication Data

US 2018/0064590 A1 Mar. 8, 2018

Related U.S. Application Data

(62) Division of application No. 14/398,624, filed as application No. PCT/CA2012/000431 on May 7, 2012, now Pat. No. 9,844,479.

(51) Int. Cl.

| | |
|---|---|
| ***A61G 5/02*** | (2006.01) |
| ***A61G 5/10*** | (2006.01) |
| ***A61G 7/05*** | (2006.01) |
| ***A61G 5/12*** | (2006.01) |
| ***A61G 5/14*** | (2006.01) |

(52) U.S. Cl.

CPC ..... *A61G 5/02* (2013.01); *A61G 5/10* (2013.01); *A61G 5/107* (2013.01); *A61G 5/1054* (2016.11); *A61G 5/1059* (2013.01); *A61G 5/12* (2013.01); *A61G 5/125* (2016.11); *A61G 5/14* (2013.01); *A61G 7/0516* (2016.11); *F04C 2270/0421* (2013.01)

(58) Field of Classification Search

CPC ..... A61G 5/125
USPC ..... 297/411.26, 411.32, 411.36
See application file for complete search history.

(56) References Cited

U.S. PATENT DOCUMENTS

| | | | | |
|---|---|---|---|---|
| 4,805,925 A | | 2/1989 | Haury | |
| 5,451,193 A | * | 9/1995 | Pickard | A61G 5/00 280/250.1 |

(Continued)

FOREIGN PATENT DOCUMENTS

| | | | |
|---|---|---|---|
| JP | 2001252310 A | 9/2001 | |
| WO | 9410879 A1 | 5/1994 | |

(Continued)

*Primary Examiner* — Gary C Hoge

(74) *Attorney, Agent, or Firm* — Norton Rose Fulbright Canada LLP

(57) ABSTRACT

A wheelchair rear wheel support assembly and a detachable arm assembly is described. The rear wheel support assembly is adjustable by finite adjustment both in the horizontal and vertical planes whereby to adjust the position of the rear wheels at a center of gravity to suit a user person to optimize the efforts of propulsion of the wheelchair by the user and thereby significantly increasing its quality of life. The detachable armrest is easily adjustable in height and can be pivoted away from its position of use by simple hand-operating levers easily accessible to the user person. It can also be easily removed with little effort.

12 Claims, 8 Drawing Sheets

(56) References Cited

U.S. PATENT DOCUMENTS

| | | | | |
|---|---|---|---|---|
| 5,544,940 | A * | 8/1996 | Stevens | A47C 7/546 297/411.28 |
| 6,270,105 | B1 | 8/2001 | Friedrich | |
| 6,341,821 | B1 * | 1/2002 | Rousseau | B60N 2/24 297/411.36 |
| 6,394,476 | B1 | 5/2002 | Molnar | |
| 8,002,300 | B2 | 8/2011 | Ludovici | |
| 8,128,172 | B2 * | 3/2012 | Tsai | A47C 1/03 297/411.36 |
| 8,628,108 | B2 | 1/2014 | Gingras | |
| 2003/0030251 | A1 | 2/2003 | Malassigne | |
| 2003/0189361 | A1 * | 10/2003 | Chen | A61G 5/12 297/115 |
| 2003/0227151 | A1 | 12/2003 | Schreiber et al. | |
| 2004/0155429 | A1 | 8/2004 | Knopf | |
| 2005/0061209 | A1 * | 3/2005 | Tien | A61G 5/10 108/4 |
| 2006/0087103 | A1 | 4/2006 | Schreiber | |
| 2009/0283983 | A1 | 11/2009 | Horacek | |
| 2009/0302571 | A1 * | 12/2009 | Osborn | A61G 5/10 280/304.1 |
| 2010/0219671 | A1 * | 9/2010 | Huang | A47C 7/54 297/411.37 |
| 2011/0018221 | A1 | 1/2011 | Anooshian | |

FOREIGN PATENT DOCUMENTS

| | | | |
|---|---|---|---|
| WO | 2006047343 | A2 | 5/2006 |
| WO | 2009045726 | A2 | 4/2009 |

* cited by examiner

WHEELCHAIR REAR WHEEL SUPPORT ASSEMBLY AND DETACHABLE ARMREST

CROSS-REFERENCE TO RELATED APPLICATION

The present application is a divisional application of U.S. non-provisional patent application Ser. No. 14/398,624, filed on Nov. 3, 2014 which is a National Phase Entry of PCT/CA2012/000431 filed on May 7, 2012 incorporated herein by reference.

TECHNICAL FIELD

The present invention relates to wheelchair mechanisms to provide ultimate comfort and ease of use to a user person and more particularly to a rear wheel support assembly which provides finite adjustment both horizontally and vertically and a detachable armrest which is adjustable vertically and pivotally displaceable to a position of non-use to facilitate access to the seat of a wheelchair by a user person.

BACKGROUND OF THE ART

Various adjustable attachments are known for securing the axle of the rear wheels of a wheelchair and some of these provide incremental adjustments. However, these incremental adjustments are found to be insufficient for locating the rear wheel at a precise location for the need of the intended occupant. Because the loads of a wheelchair are transmitted to its seat by the rear wheel through the rear axle and its attachment, it is important to assure that these attachments are rigid and well secured to the frame of the wheel chair as it is subjected to stresses exerted on different axes. In U.S. Pat. Nos. 5,284,350, 4,477,098 and 5,060,962, the mounting plates for the rear axle are mounted horizontally and these have proven problematic in view of the different angular loads transmitted thereto through the rear wheel axle. It is also important to construct these mounting plates to provide maximum rigidity and infinite adjustments in both the x and y axes whilst maintaining the mounting attachments as light as possible. It is also desirable that the rear axle mounting assembly can be adapted for wheel chairs which are also collapsible.

The positioning of the rear wheel axle of a wheelchair on its center of gravity is directly proportional to the performance of the wheel chair. A center of gravity that is too much to the rear of the wheelchair provides more resistance on the rear wheels which need to be displaced by the user person. A center of gravity that is too forward provides for a very unstable wheel chair. Accordingly, it is important to provide for a rear axle support assembly which provides infinite adjustments to precisely position the rear wheel axis on its center of gravity taking in consideration the intended user. The effort of propulsing the rear wheels of a wheelchair is proportional to the position of the rear wheel axis and a perfectly adjusted position will considerably reduce the efforts necessary to propulse the wheelchair by diminishing the propulsion effort exerted by the user person. Such precisely disposed rear wheel axis will reduce the fatigue of the user person and in long term greatly retard the wear of the articulations of the user person.

Wheelchair armrests are also essential elements for the comfort of a user person. As well as being an element which is aesthetically pleasing it also is important that the armrest be strong, functional and ergonomic. Such armrests must also protect the clothing of the user, that is to say it must be designed such that the clothing of the user person not be tangled in the armrest or damaged or soiled thereby. It should prevent the clothing of the user person from being tangled up in the rear wheels during movement of the wheelchair. There are two principle utilizations of a wheelchair armrest and that of resting the arms of the user when the wheelchair is at rest and also permits the user person as a rigid grasping member in order to disembark from the wheelchair or move itself on the seat when uncomfortable. A person may access its wheelchair and disembark it several times during a day and therefore this armrest must also be rigid due to the forces applied thereto by the user person. Several types of armrests are known for a wheelchair and U.S. Pat. Nos. 4,768,797, 3,993,351, and 5,255,956 are examples of these. Several armrest designs are also known for office chairs, particularly those intended for persons using a computer and being seated thereon for long periods of time. Concerning wheelchair armrests, some of these are adjustable in height by the use of a slide bar support, thus providing a "T"-shaped structure. Another type of armrest, particularly for office chairs, is one that is pivotally mounted at a rear end whereby to pivot upwardly and rearwards and these are secured on a fixed pivot pin usually to the backrest of the armchair or the rear of the seat thereof.

DISCLOSURE OF INVENTION

It is a feature of the present invention to provide a wheelchair rear wheel support which substantially overcomes the above-mentioned disadvantages of the prior art.

Another feature of the present invention is to provide a wheelchair rear wheel support assembly to which is secured the rear axle of the wheelchair and which provides finite adjustment both vertically and laterally whereby to precisely position the rear wheel axis at an ideal center of gravity for an intended user person.

Another feature of the present invention is to provide a detachable armrest assembly for a chair and particularly, but not essentially, a wheelchair, and which is adjustable vertically and entirely pivotable rearwardly and which is easy to adjust and retract by the user person by the use of a hand or fingers.

According to the above features, from a broad aspect, the present invention provides a wheelchair rear wheel support assembly for supporting the rear wheels thereof. The support assembly comprises an axle support bracket having attachment means adapted for securing the axle support bracket to a side frame of the wheelchair. The axle support bracket has a straight vertical slot therein defining opposed parallel inner vertical edge walls having incremental engageable means. An axle support means is provided for adjustably supporting the axle through the vertical slot. The axle support means has clamping means for clampingly engaging same with the incremental engageable means at a desired location along the vertical slot.

According to a further broad aspect of the present invention, there is provided a detachable armrest assembly for a chair. The armrest assembly comprises a support housing. A detachable coupling is provided for removably securing the support housing to a side member of a seat frame. An armrest is secured to the support housing. Vertical displacement means secures the armrest to the support housing to adjust the height of the armrest relative to the support housing. Connectable hinge means is securable to the support housing for pivoting the housing in a rearward direction with the detachable coupling in a disengaged position.

BRIEF DESCRIPTION OF THE DRAWINGS

A preferred embodiment of the present invention will now be described with reference to the accompanying drawings in which.

MODES FOR CARRYING OUT THE INVENTION

Figure 1:
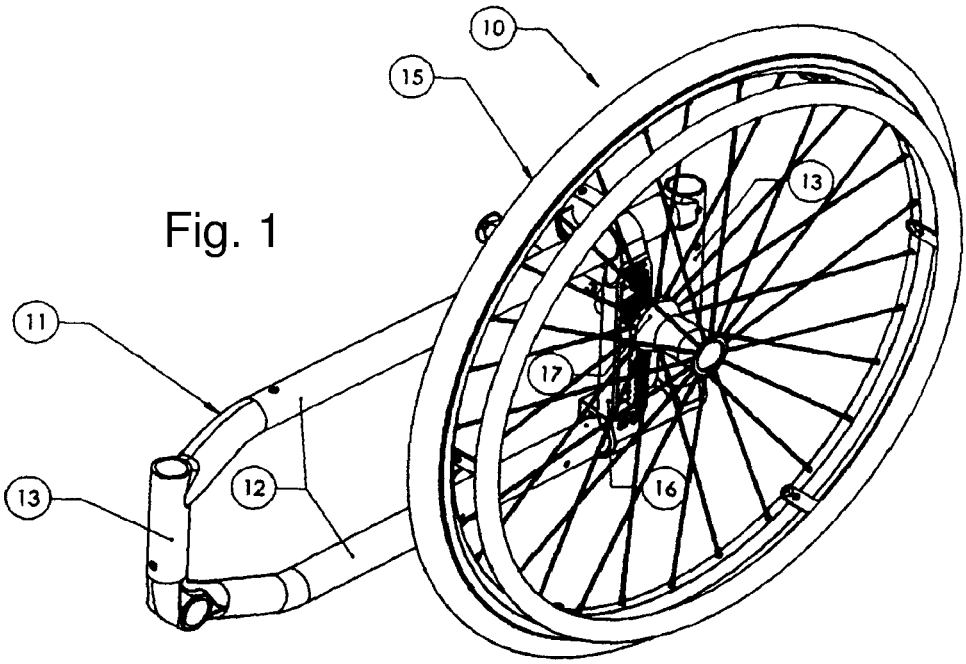
FIG. 1 is a perspective view of a rear wheel of a wheelchair illustrating the rear wheel axle support assembly of the present invention secured to a side frame of the wheel chair.
Figure 3:
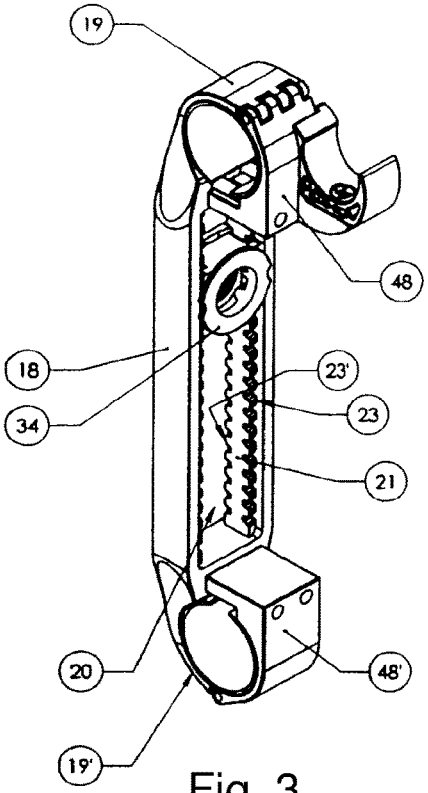
FIG. 3 is an assembled perspective view of FIG. 2.
Figure 4:
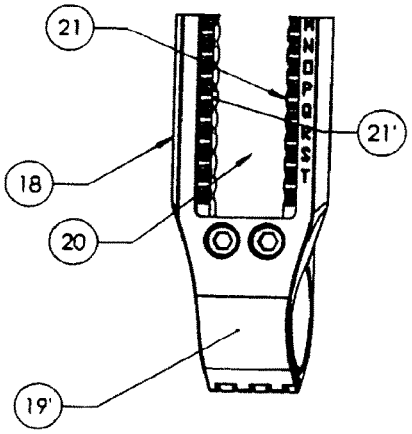
FIG. 4 is a fragmented view showing a portion of the axle support bracket and its vertical slot provided with engageable grooves formed in opposed outer side end portions of the inner vertical edge walls of the slot.

Referring now to the drawings and more particularly to FIG. 1, there is shown generally at 10 a portion of a wheelchair side frame 11 which includes a pair of parallel oriented horizontal tubular members 12 interconnected at opposed ends to tubular members 13. Only a side of the wheelchair frame assembly is herein illustrated. A rear wheel 15 is secured to the side frame 11 by the rear wheel support assembly 16 of the present invention. The rear wheel 15 provides the motor means for a user person to displace the wheelchair. The rear wheel axle support assembly 16 provides for the rear wheel axle 17 (see FIG. 2) to be precisely positioned at the center of gravity of the wheelchair to suit the needs of an intended user person.

With reference now to FIGS. 2 to 8, there will be described the wheel chair rear wheel support assembly 16 of the present invention. The rear wheel support assembly 16 comprises an axle support bracket 18 provided with attachment means in the form of tube clamps 19 and 19' provided at the top and lower ends of the support bracket whereby to secure the axle support bracket to the upper and lower side frame tubes 12 (see FIG. 1). The axle support bracket 18 is provided with a straight vertical slot 20 defining opposed parallel inner vertical edge walls 21 and 21', each edge wall having incremental engageable means in the form of a plurality of engageable grooves 22 disposed in opposed side portions 23 and 23' (see FIG. 3) of each of the opposed inner vertical edge walls 21 and 21' (see FIG. 4).

An axle support assembly 25 is engageable with the grooves 22 at a desired vertical location along the slot 20 for supporting the axle through the slot. This axle support assembly 25 is provided with clamping means for clamping engaging the axle support assembly at a desired location along the slot depending on the physical characteristics of the intended person to use the wheelchair. The precise location of the axle 17 on the center of gravity of the wheelchair provides for the comfort of that person as well as facilitating the propulsion of the wheelchair with minimal effort, as mentioned hereinabove.

Figure 7A:
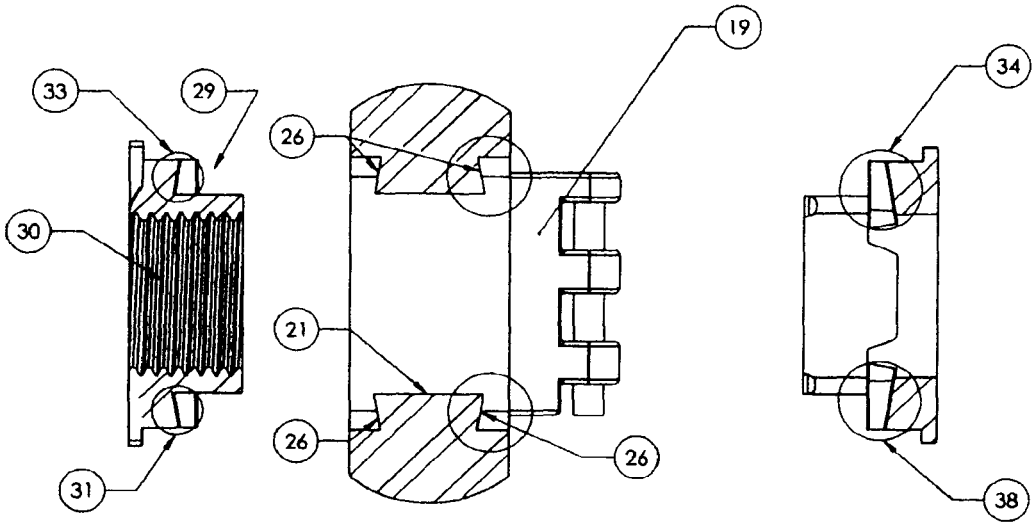
FIG. 7A is an exploded section view showing the relationship between the support bracket and the outer and inner clamping collars.
Figure 7B:
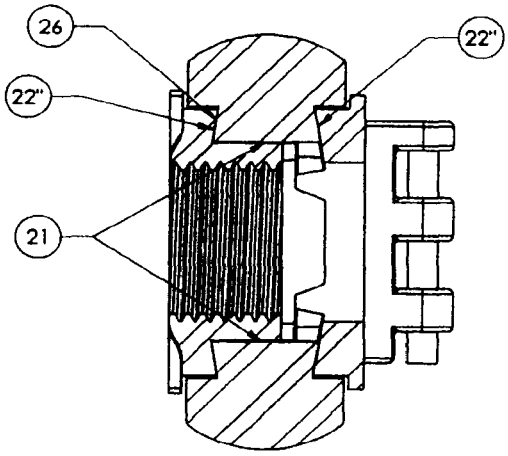
FIG. 7B is a section view showing the clamping collars in position and in engagement with aligned grooves of the slot in which said outer and inner clamping collars are clampingly secured.
Figure 8:
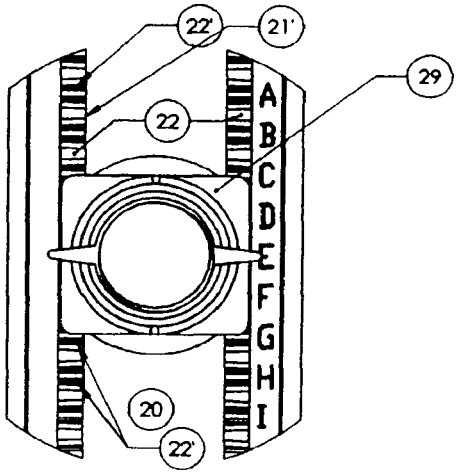
FIG. 8 is a side view showing the outer clamping collar in position in the vertical slot of the axle support bracket.

As illustrated more clearly in FIGS. 7A, 7B and 8, the engageable grooves 22 each define opposed spaced inwardly tapering horizontal side walls 22' and a bottom wall 22". The bottom wall 22" tapers inwardly, as shown in FIGS. 7A and 7*b*, as illustrated by reference numeral 26, from associated ones of the inner vertical edge walls 21 of the straight vertical slot 20.

Figure 5:
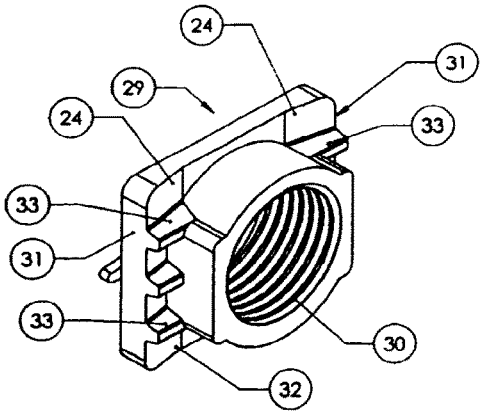
FIG. 5 is a perspective view of the outer clamping collar.

Referring again to FIG. 2, the axle support assembly 25 is comprised of a hollow tubular support member or tube 27 provided with a threaded outer surface 28 and through which the axle 17 extends in sliding fit therein. The axle support assembly is provided with a clamping means which is comprised of an outer clamping collar 29 which, as shown in FIG. 5, has a threaded circular through-hole 30 adapted to engage the outer collar 29 with the threaded outer surface 28 of the axle support tube 27, a shown in FIG. 2. The outer clamping collar 29 is further provided with opposed flange walls 31 on a rear surface 32, which has a slope 24 and on which there is integrally formed transversely aligned teeth formations 33. These teeth formations are configured for close-fit engagement in selected ones of transversely aligned engageable grooves 22 in the opposed parallel inner vertical edge walls of the slot of the support bracket 18.

Figure 6:
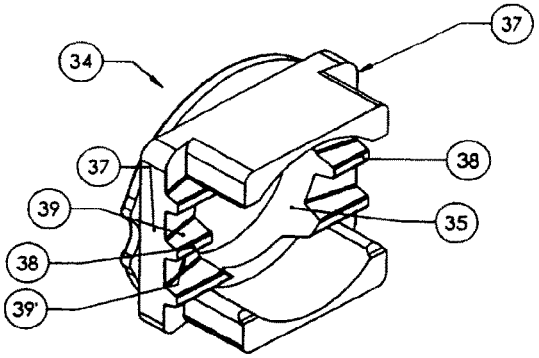
FIG. 6 is a perspective view of the inner clamping collar.

An inner clamping collar 34, as better illustrated in FIG. 6, is also provided with a circular through-hole 35 but dimensioned to slide over the outer threaded surface 28 of the axle support tube 27. It is also provided with opposed flange walls 37 having transversely aligned teeth formations 38 formed on an inner surface 39 thereof which has opposed sloped portions 39'. The teeth formations 38 are configured for close-fit engagement in selected ones of transversely aligned engageable grooves 22 of the support bracket 18 on an inner side of the bracket and lying in a common horizontal plane with the engageable grooves on the other side engaged by the outer clamping collar, as shown in FIG. 2.

Figure 2:
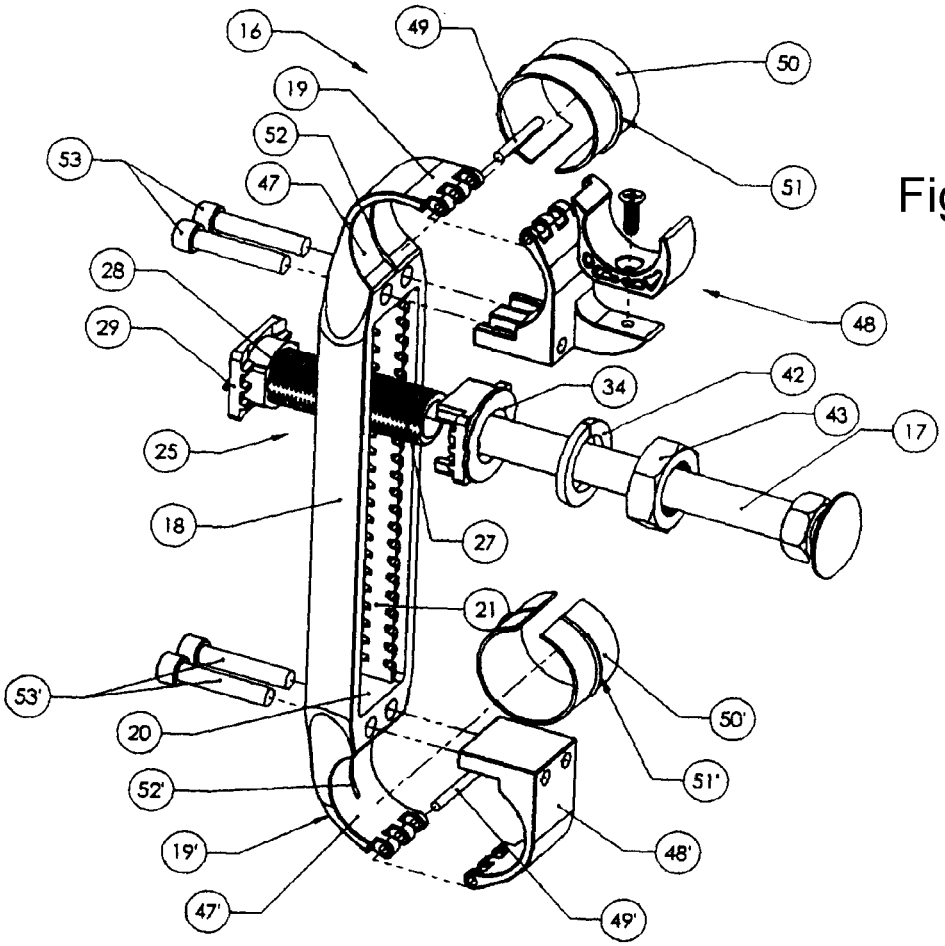
FIG. 2 is an exploded perspective view of the rear wheel support assembly showing its component parts.

As shown in FIG. 2, in order to position the axle support tube 27 at the desired location along the slot 20 of the support bracket 18, the outer clamping collar 29 is firstly secured to the threaded outer surface 28 of the axle support tube 27 from an outer end thereof. This outer clamping collar 29 is then positioned in selected grooves on an outer side of the slot 20. The inner clamping collar is then slid over the threaded outer surface 28 of the axle support tube 27 and located in corresponding grooves 22 on an inner side of the support bracket 18 wherein grooves on the outer and inner side are disposed in a common plane. To facilitate this alignment, indicia means in the form of letters 40 or numbers are provided along an edge 41 of the support bracket adjacent the grooves 22 and on opposed sides of the bracket to facilitate the perfect alignment of the outer and inner clamping collars. An O-ring washer 42 is then slid over the threaded outer surface 28 of the axle support tube 27 and a nut fastener 43 is then threaded over the threaded outer surface 28 of the tube 27 whereby the collars are clamped together through the grooves and the axle support tube is immovably secured. The axle 17 may then be received in the axle support tube 27.

Because a rear wheel support axle 17 is subjected to various forces due to the displacement of the rear wheels 15 on all sorts of surfaces and the load of the user person and its motions, it is imperative that the axle support assembly be rigidly connected to the support bracket 18 to compensate for all sorts of forces exerted in all directions onto the rear wheel support axle 17. For this reason, the teeth formations 33 of the outer clamping collar and 38 of the inner clamping collar 34 be shaped for close-fit engagement in the engageable grooves 22 of the slot 20 which shape resists to these forces transmitted to the rear wheel axle 17. This shape is better illustrated in FIGS. 5 and 6 and because the grooves of both collars have an identical shape, only those of FIG. 6 are herein described. As hereinshown, the teeth 38 have a tapered profile which is inverse to the tapered profile of the engageable grooves 22 defined by the tapering bottom wall thereof. The tapered profile of the teeth is larger adjacent the through-hole as identified by reference numeral 45 and tapered to a smaller end 46 at an outer edge of the flange walls 37. Thus, the inner surface of the flange walls 37 tapers inwardly, as shown at 39'.

It is pointed out that it is conceivable that the clamping means be inversely coupled, that is to say that the inner clamping collar 39 be provided with an inner threaded through-hole for securement to the axle support tube 27 and that the outer clamping collar 29 be provided with a through-hole having a smooth inner surface with the O-ring 42 and fastening nut 43 engaged on the outer side of the support bracket 18.

Referring again to FIG. 2, the tube clamps 19 and 19' are herein constructed for sliding fit engagement along the tubular members 12 of the side frame whereby to provide infinite adjustment of the location of the support bracket therealong. Indicia means (not shown) could also be provided on these tubular members 12 to precisely align the support bracket 18 therebetween, although this is not deemed necessary due to the precise construction of the side frame 11 and the pair of tubular members 12. These tube clamps 19 and 19' each comprise a tube clamping section 47 formed integral with the axle support bracket, and detachable clamp sections 48 and 48' pivotally secured thereto by pivot pins 49 and 49', respectively. Compressible sleeve 50 and 50' are disposed on the tubular members 12 and provide for non-slip engagement with the tubular members. The compressible sleeves have rib formations 51 and 51' for location in grooves 52 and 52' formed on the inner surface of the tube clamping sections 47 and 47'. Bolt fasteners 53 and 53' are provided to clampingly engage the clamp sections to apply clamping pressure between the clamp sections about the compressible sleeves 50 and 50'.

Figure 9:
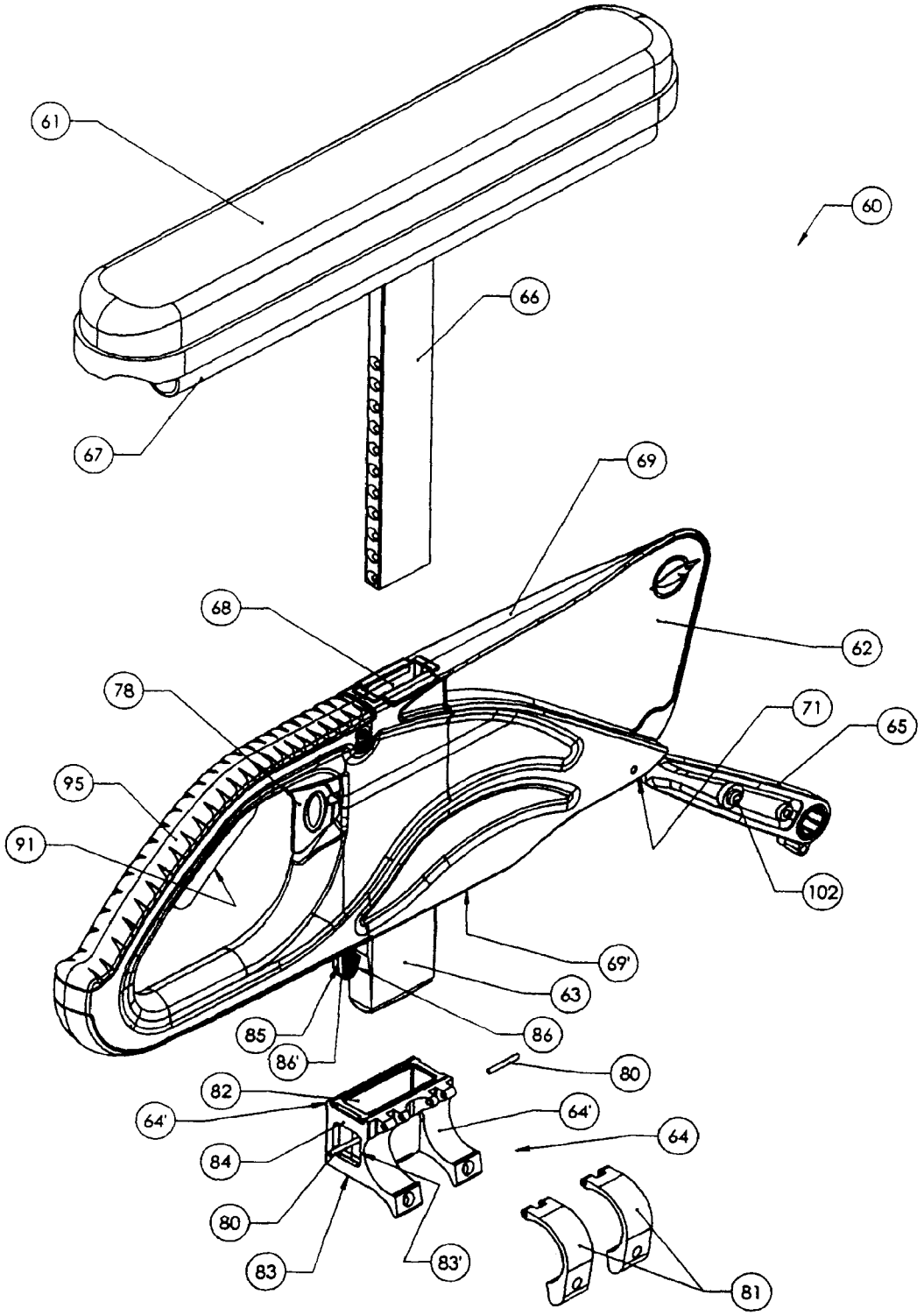
FIG. 9 is an exploded view showing the main component parts of the detachable armrest assembly.

With reference now to FIGS. 9 to 16, there will be described the construction and operation of the detachable armrest assembly of the present invention for securement to a chair and particularly, but not exclusively, a wheelchair. As shown in FIG. 9, the detachable armrest assembly 60 comprises an armrest component 61 having a support post 63 projecting from a lower end thereof to be received in a guide channel 68 of a support housing 62 and into a through-bore 82 of a detachable coupling 64 which is adapted to be secured to a side member 65, herein a tubular member of a wheelchair seat frame, only a portion being shown in FIG. 10. The support housing 62 is detachably securable to a pivoting finger element 65 which is pivotally secured the side frame 70, as will be described later, whereby to displace the support housing from a position of use to a storage position of non-use. As hereinshown, the support housing is formed as a narrow substantially flat side wall to prevent the clothing of a user person seated on the wheelchair from being tangled in the rear wheels of the chair.

As shown in FIG. 9, the armrest 61 has its support post 66 depending therefrom and disposed transverse to an armrest support frame 67. This support post 66 constitutes a vertical displacement means for the armrest 61. The support post 66 extends into the guide channel 68 extending through the support housing 62 from the top wall 69 of the housing and exits through its bottom wall 69' to be received in the detachable coupling 64 where it is lockingly engaged. The pivoting finger element 65 is secured into an elongated slot cavity 71 (see FIGS. 10 and 16) formed in a rear lower portion of the housing and constitutes a connectable hinge means for pivoting the housing in a rearward direction to a position of non-use or storage position as illustrated in FIG. 11. Both the pivoting finger element and the housing and armrest component 61 are detachable from the side frame of the wheelchair, as shown in FIG. 9. The detachable coupling 64 is also detachable but may remain in position as it is constructed not to obstruct a user person seated on a seat of the wheelchair adjacent the seat frame 70.

Figure 12:
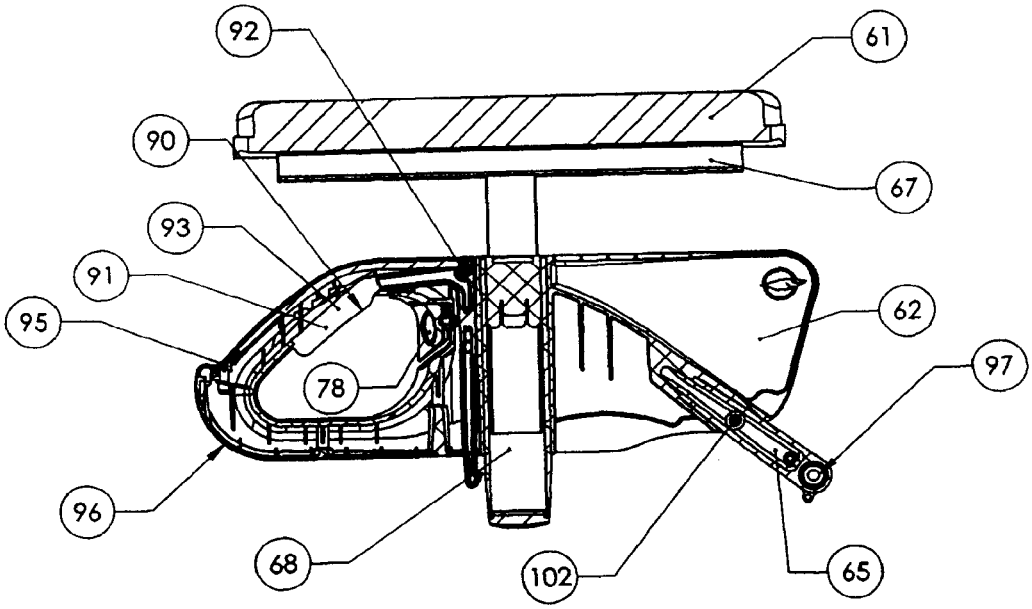
FIG. 12 is a side view of the detachable armrest assembly and partly fragmented to illustrate the construction of the detachable coupling.
Figure 13:
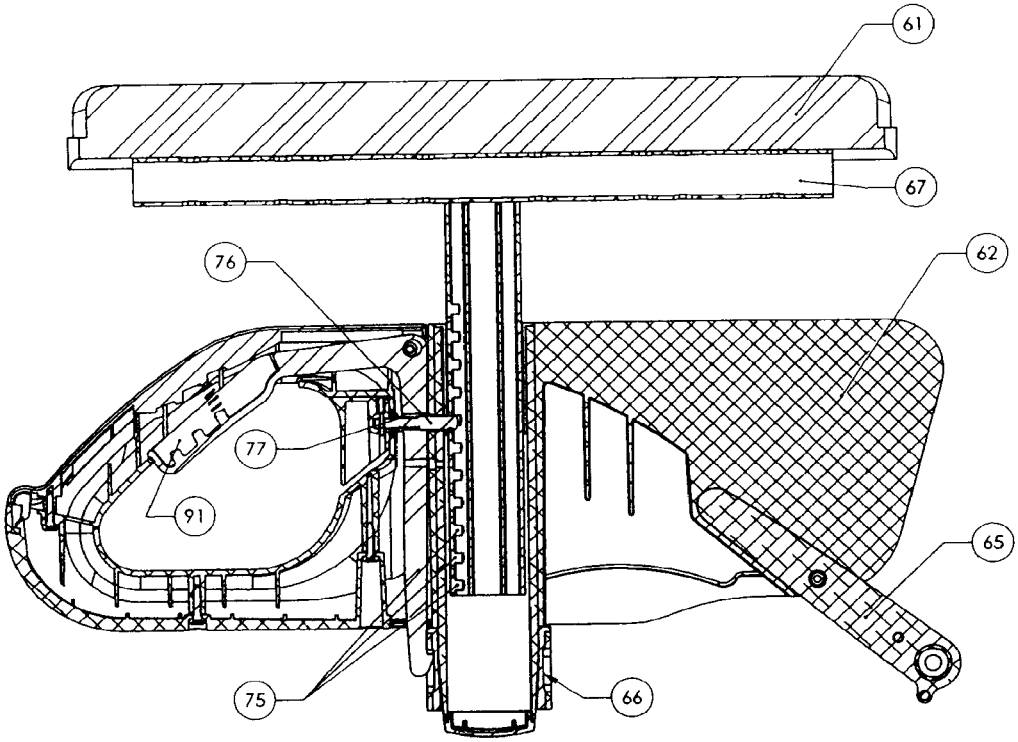
FIG. 13 is a side view, partly fragmented, showing the construction of the support post secured to the support frame of the armrest.
Figure 14:
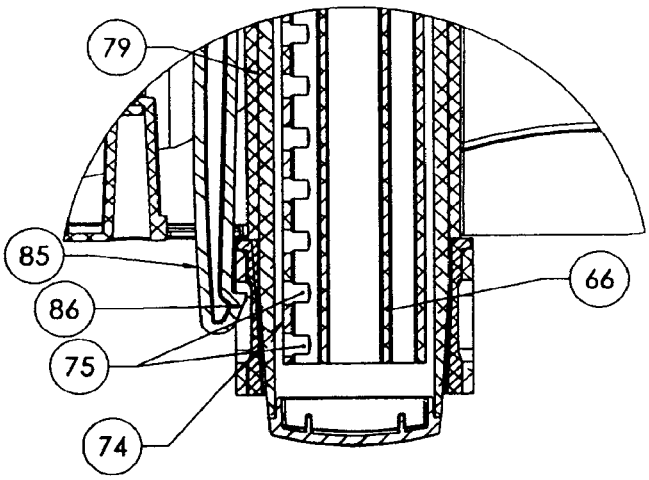
FIG. 14 is a fragmented side view better illustrating the plurality of equidistantly spaced grooves provided in a forward edge of the support post.
Figure 15:
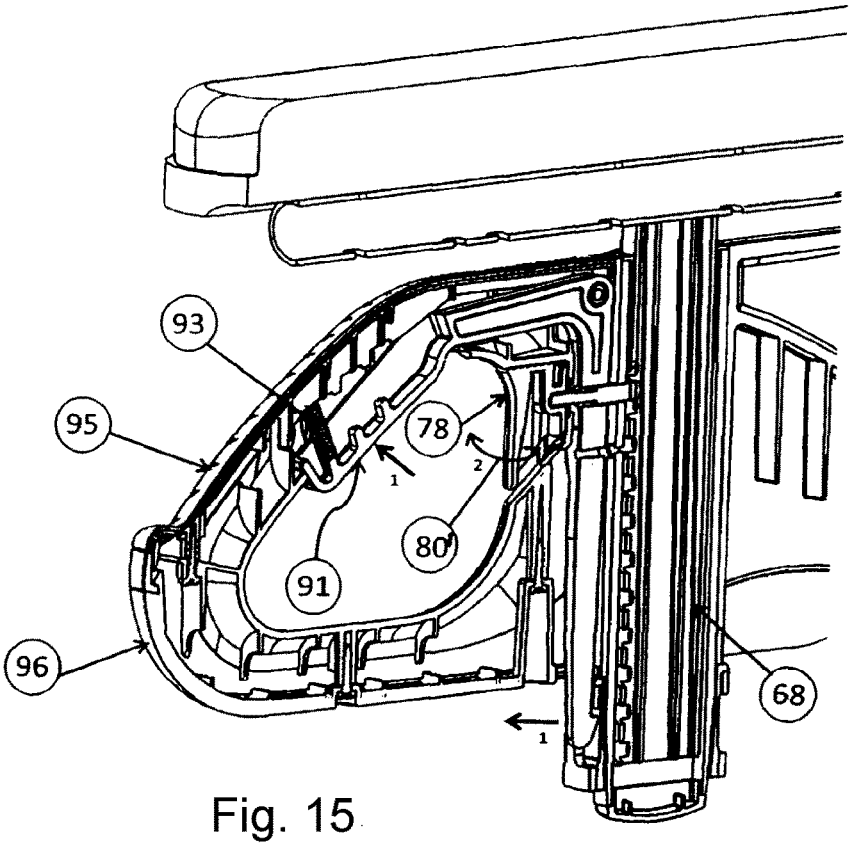
FIG. 15 is a perspective view illustrating the movement of the side actuable trigger for disconnecting the support post from the support housing and the actuating lever to disconnect the detachable coupling from the side member of the seat frame.

Referring now to FIGS. 12 to 14, there will be described the construction and operation of the vertical displacement means, that is to say, the adjustable connection of the support post 66 in the guide channel 68 of the support housing 62. As shown in FIGS. 13 and 14, the support post 66 is an elongated rectangular support post having a forward edge 74 provided with a plurality of equidistantly spaced grooves 75 in a major portion thereof. A plunger pin 76, which constitutes a support post engaging means, is spring-biased against the forward edge 74 of the support post 66 for engagement with a selected one of the grooves 75 by displacing the armrest and post. A spring 77 is located behind a trigger 78 and urges the plunger pin 76 against the forward edge 74 of the support post through a cavity formed in the front edge wall 79 of the guide channel 68, illustrated in FIG. 12. The trigger 78 is connected to the plunger pin and is displaceable from side-to-side as indicated by arrow 80' in FIG. 15. When the trigger is displaced to either of the sides, it has an eccentric rear formation which pulls on the plunger pin 76 to disconnect it from the engaged groove 75 permitting free movement of the support post within the guide channel 68 whereby to relocate the arm at a desired elevation with respect to the top wall 69 of the support housing 62. The plunger pin and trigger constitute a locking mechanism to arrest the support post at a desired location to adjust the height of the armrest. When the trigger 78 is not engaged by the user person, the spring pulls it to its normal straight position and biases the plunger pin against the forward edge 74 of the support post to engage into a desired one of the grooves 75 by the displacement of the armrest 61 and the post in an upward or downward position until a groove is engaged. The pin has a smooth forward edge (not shown) for sliding abutment against the forward edge of the support post. The trigger 78 has an eccentric seat formation such as to exert a pulling force on the plunger pin to move it out of engagement with the selected one of the grooves when the trigger is moved to either side.

Referring to FIG. 9, there will be described the construction of the detachable coupling 64. In this Figure, only the support base portion 64' is shown and it has a pivot pin receiving attachment 80 to connect clamping collard 81 thereto. The support base member 64' is also provided with a vertical rectangular through-bore 82 for receiving the lower end portion of the support post 63. A latch claw receiving cavity 83 is provided in a forward wall 84 of the support base member 64' for engagement by a latching member 85 which projects from the bottom wall 69' of the support housing adjacent a hollow guide post 63 projecting therefrom and aligned with the channel 68 to extend the channel 68. The latching member 85 has an engageable claw formation 86 at an end thereof, as better seen in FIG. 14, and is spring-biased in the direction of the forward wall 84 of the support base member 64' and disposed to enter into the latch claw receiving cavity 83 when the guide post 63 is positioned within the through-bore 82 and the support housing 62 disposed seated on the top of the support base member 64'. The claw formation will grasp under the upper edge of the latch claw receiving cavity 83 to retain the housing secured in position over the detachable coupling 64, as shown in FIG. 10.

A latch actuator mechanism 90 is provided for disconnecting the latching member 85 from the latch claw receiving cavity 83 to permit the support housing to be lifted from engagement for disconnection or to be pivoted in a rearward direction, as shown in FIG. 11 to place it in a position of non-use or storage position to permit the user person ease of entrance and exit from the seat of the wheelchair.

The latch actuator mechanism 90 has a hand-operable lever 91 for pivotal displacement on a pivot connection 92. A spring 93 biases the hand-operable lever 91 to its position as shown in FIG. 12 with the latching arm or member 85 spring-biased in a forward direction, as illustrated in FIG. 14, whereby when the housing is pushed down onto the support base member 64', the rounded end 86' (see FIG. 9) of the claw 86 will cause the latching arm 85 to ride on the front wall 84 of the support base section 64' and clamp into the latch claw receiving cavity 83 by the downward spring force exerted on the hand-operable lever 91 which was compressed by the outward movement of the latching member as it was pushed outwardly by the wall 84 of the support base member. In order to disconnect the engageable claw formation 86, it is simply necessary to push the hand-operable lever 91 within the handle grip formation 95 forming part of the front handle 96 of the housing 62. As hereinshown, the hand-operable lever 90 is made of a single part which has an angulated pivotal link defining the external hand engaging lever 91 in a branch section thereof and the latching member or finger 85 in a further section thereof extending at an abrupt angle thereto. The pivot connection 92 is disposed substantially at the intersection of the sections for pivoting displacement of the latching member 85.

Figure 10:
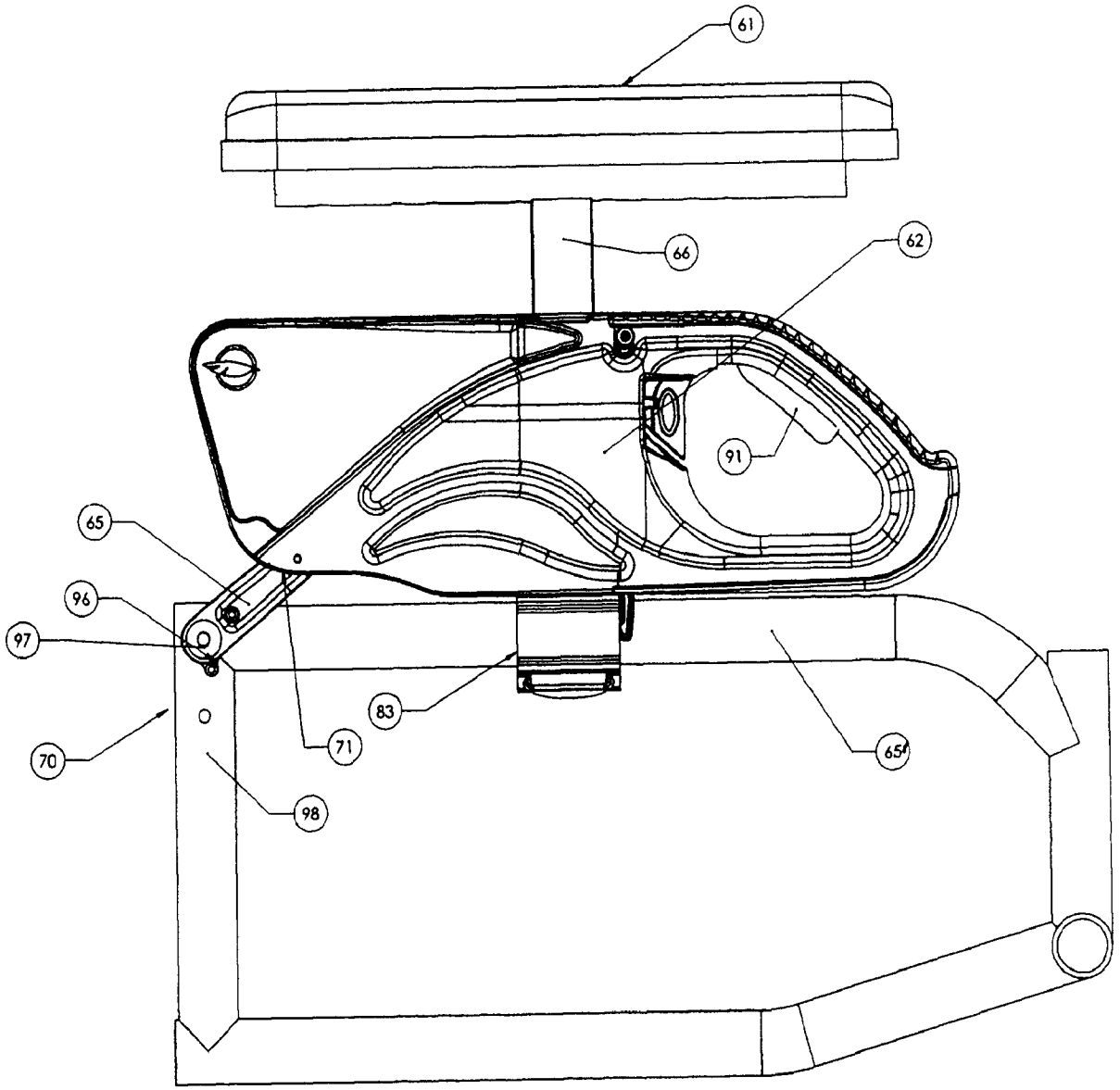
FIG. 10 is a side view showing the detachable armrest assembly secured to a side member of a seat frame of a chair, herein a wheelchair seat frame.
Figure 11:
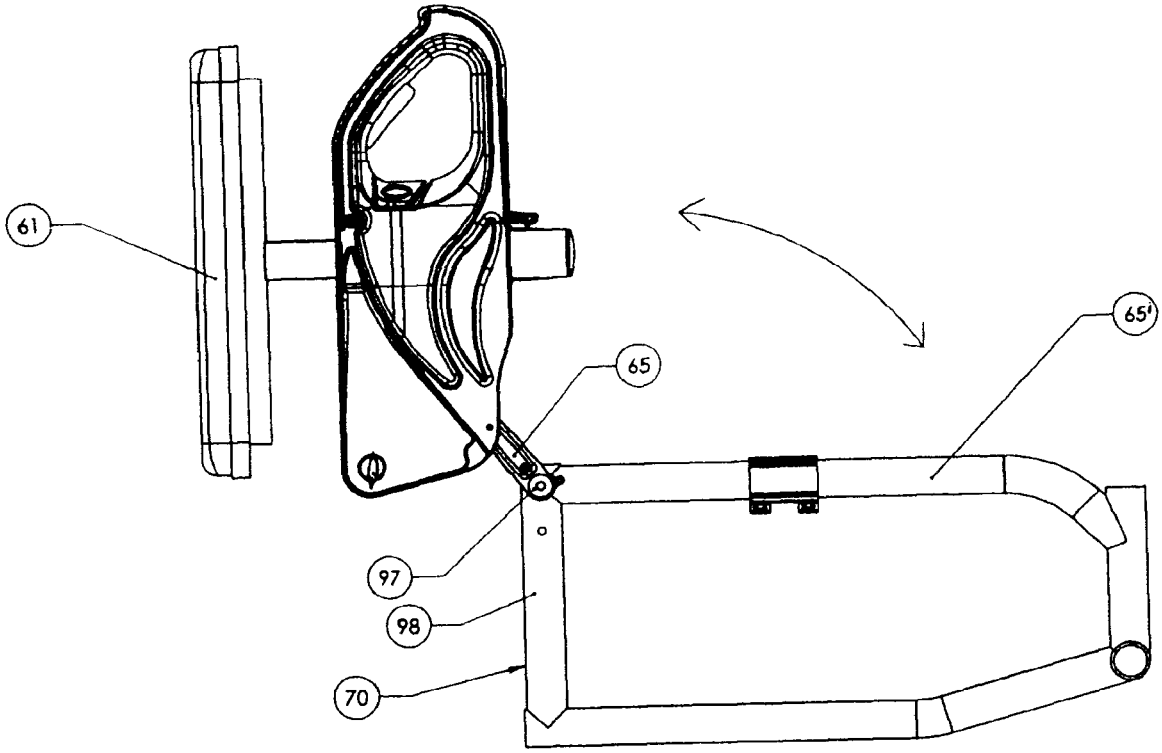
FIG. 11 is a view similar to FIG. 10, but showing the detachable armrest assembly in a retracted position on its detachable hinge connection.
Figure 16:
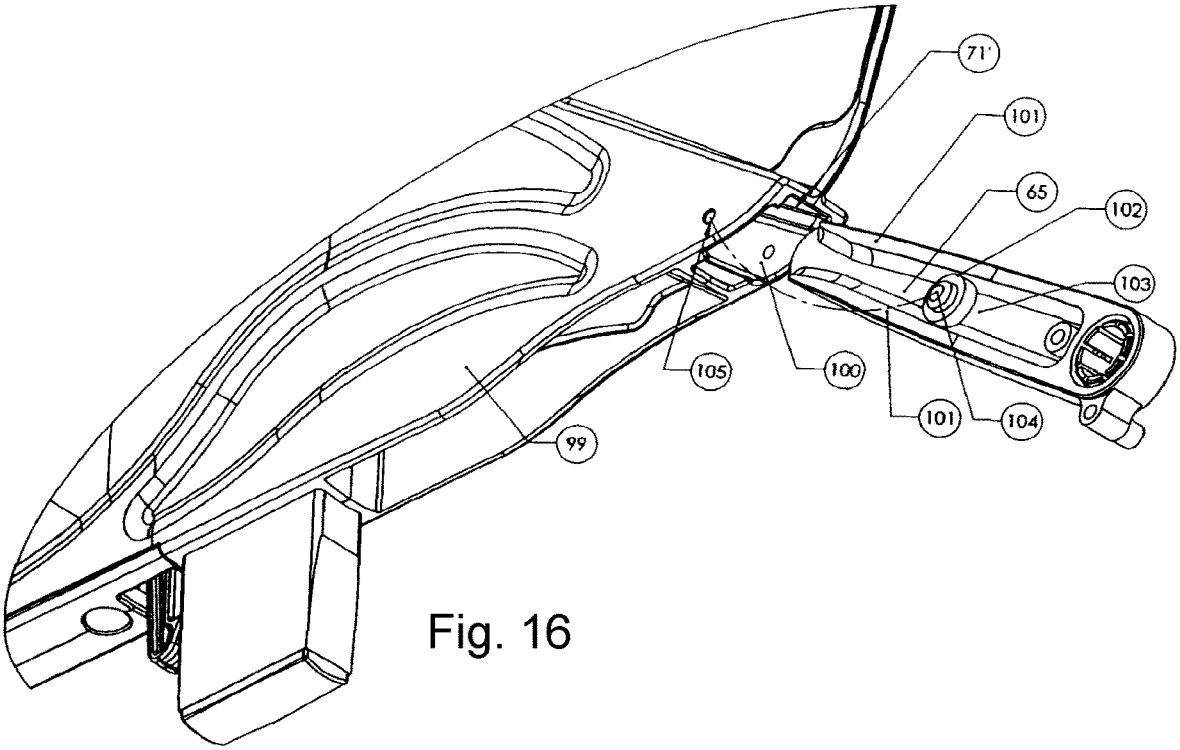
FIG. 16 is a fragmented perspective view illustrating the removable attachment mechanism for removable retention of the pivoting finger in the connecting slot cavity of the support housing.

With reference now to FIGS. 10, 11 and 16, there is shown the construction and operation of the pivoting finger element 65 pivotally secured at an end 96 to a pivot connection 97 secured to the top of a vertical tubular member 98 of the seat frame 70 behind the tube 65'. In FIG. 10, the support housing is shown with a side cover wall removed therefrom whereby to illustrate the shape of the elongated slot cavity 71. The support housing 62 has its component parts molded from reinforced structural plastics and the slot cavity is formed in an inner wall thereof. With the cover plate 99, see FIG. 16, secured thereover the slot cavity has a lower open end 100.

As better seen in FIG. 16, the elongated finger element 65 has opposed edge walls 101 which progressively converge towards a free end of the finger element. The slot cavity 71 also has opposed side cavity walls tapering towards an inner end of the slot cavity, as shown in FIG. 10, and configured for guiding and sliding engagement with the opposed side edges of the elongated finger element when disposed in siding fit in the slot cavity from the lower open end 100. The finger element 65 has a spring-biased bearing element 102 in a side wall 103 thereof facing the cover plate 99. The spring-biased bearing element 102 is a spring-biased ball bearing 104 retained in a chamber with a spring acting on the ball bearing. A seat formation is formed in the cover or side wall 99 in the form of a circular hole 105 and is dimensioned to receive a top portion of the spring-biased ball bearing 104 therein. The ball bearing is urged in the hole 105 when positioned there adjacent and provides sufficient retention force to maintain the support housing 62 connected to the finger element 65. To release the connection of the ball bearing from the circular hole 105, it is simply necessary to apply an outward pulling force on the housing overcoming the retention force of the ball bearing and the support housing is disconnected from the pivoting finger to be removed from the wheelchair.

It is within the ambit of the present invention to cover any obvious modifications of the preferred embodiment described herein provided such modifications fall within the scope of the appended claims.

The invention claimed is:

1. A detachable armrest assembly for a chair, said armrest assembly comprising a support housing, a detachable coupling for removably securing said support housing to a side member of a seat frame, an armrest secured to said support housing, vertical displacement means securing said armrest to said support housing to adjust the height of said armrest relative to said support housing, and connectable hinge means securable to said support housing for pivoting said housing in a rearward direction with said support housing disengaged from said detachable coupling, the detachable coupling having a latch actuator mechanism to permit said support housing to be pivoted in said rearward direction, said latch actuator mechanism having an external hand operable lever movable in a same direction as the rearward direction of the housing to initiate the pivoting of said housing in the rearward direction.

2. A detachable armrest assembly as claimed in claim 1 wherein said vertical displacement means comprises a support post retained in a guide channel of said armrest and projecting thereunder, said support post guidingly extending into said guide channel from a top end thereof, a support post locking mechanism in said support housing for disconnectible engagement with said support post, support post engaging means associated with said support post locking mechanism to arrest said support post at a desired location to adjust said height of said armrest, and finger actuating means secured to said support housing and actuable by a user person to disconnect said support post engaging means to permit said support post to slide in opposite directions in said support housing.

3. A detachable armrest assembly as claimed in claim 2 wherein said support post is a rectangular elongated support post having a forward edge provided with a plurality of equidistantly spaced grooves, said support post engaging means being a plunger pin spring biased against said forward edge for engagement with a selected one of said grooves, said finger actuating means being a trigger secured to said plunger pin actuable to pull said plunger pin against a spring force to retract said plunger pin from engagement with said selected one of said grooves and free said support post for sliding displacement in said support housing.

4. A detachable armrest assembly as claimed in claim 3 wherein said trigger is a side actuable trigger which when in a normal straight position, exerted by said spring force, maintains said plunger pin engaged with said selected one of said grooves; said trigger when displaced sideways on either side of said normal position displaces an eccentric seat formation thereof to cause said plunger pin to move outwardly out of engagement with said selected one of said grooves.

5. A detachable armrest assembly as claimed in claim 1 wherein said detachable coupling comprises a support base member secured to said side member of said seat frame, said support base member having a vertical through-bore for receiving a support post projecting from a bottom wall of said support housing, a latching member projecting from a bottom wall of said support housing adjacent said support post and spring-biased for engagement with an engageable formation of said attachment base member, the latch actuator mechanism for disconnecting said latching member from said engageable formation to permit said support housing to be pivoted in said rearward direction or removed from its connection to said side member of said seat frame.

6. A detachable armrest assembly as claimed in claim 5 wherein said latch actuator mechanism has the external hand operable lever for pivotal displacement of said latching member.

7. A detachable armrest assembly as claimed in claim 6 wherein said latching member is a latching finger projecting under a bottom wall of said support housing, said latching finger having an engageable end claw formation biased for retention engagement with said engageable formation disposed in a front side wall of said attachment base member, and an angulated pivotal link arm defining said external hand engaging lever in a branch section thereof and said latching finger in a further branch section thereof, a pivot connection disposed at an intersection of said branch sections for pivoting displacement of said latching finger from said engageable formation of said attachment base member.

8. A detachable armrest assembly as claimed in claim 7 wherein said hand-engaging lever projects under a forward hand grip portion of said support housing, and a spring retained in said hand grip portion and acting against said hand-engaging lever to apply an outward spring force thereagainst to cause said latching finger to pivot on said pivot connection to transfer said spring force to said engageable claw formation for engagement with said engageable formation.

9. A detachable armrest assembly as claimed in claim 1 wherein said connectable hinge means comprises a pivotally connected finger element pivotally secured at one end to said side member of said seat frame, said support housing having an elongated slot cavity formed in a rear lower portion thereof and oriented to receive and retain said pivoting finger element when positioned therein from a lower open end of said slot cavity.

10. A detachable armrest assembly as claimed in claim 9 wherein said finger element is an elongated finger element having opposed edge walls progressively converging towards a free end thereof, said slot cavity having opposed side cavity walls tapering towards an inner end of said slot cavity and configured for guiding engagement with said opposed edge walls of said elongated finger element when disposed in sliding fit in said slot cavity from said lower open end thereof, said finger element having a spring-biased bearing element in a side wall thereof positioned for frictional engagement in a seat formation formed in a side wall of said support housing adjacent said slot cavity.

11. A detachable armrest assembly as claimed in claim 10 wherein said spring-biased bearing element is a spring-biased ball bearing, said seat formation being constituted by a circular hole formed in said side wall of said housing and dimensioned to receive a top portion of said spring-biased ball bearing therein, said ball bearing being released from engagement with said circular hole by a pulling force exerted between said slot cavity and said pivoting finger element causing said ball bearing to retract against a spring force acting thereon.

12. A detachable armrest assembly as claimed in claim 11 wherein said chair is a wheelchair.

* * * * *